US006192669B1

(12) United States Patent
Keller et al.

(10) Patent No.: US 6,192,669 B1
(45) Date of Patent: Feb. 27, 2001

(54) COMBUSTION CHAMBER OF A GAS TURBINE

(75) Inventors: Jakob Keller, Dottikon; Roger Suter, Zürich, both of (CH)

(73) Assignee: Asea Brown Boveri AG, Baden (CH)

( * ) Notice: Subject to any disclaimer, the term of this patent is extended or adjusted under 35 U.S.C. 154(b) by 0 days.

(21) Appl. No.: 09/044,910

(22) Filed: Mar. 20, 1998

(30) Foreign Application Priority Data

Mar. 20, 1997 (EP) ..... 97810167

(51) Int. Cl.[7] ..... F02C 3/08
(52) U.S. Cl. ..... 60/39.36
(58) Field of Search ..... 60/39, 36

(56) References Cited

U.S. PATENT DOCUMENTS

| | | | | |
|---|---|---|---|---|
| Re. 34,962 | * | 6/1995 | Shekleton et al. | 60/39.36 |
| 3,010,281 | | 11/1961 | Cervenka et al. . | |
| 3,269,119 | | 8/1966 | Price . | |
| 3,722,216 | * | 3/1973 | Bahr et al. | 60/39.36 |
| 5,109,671 | * | 5/1992 | Haasis | 60/39.36 |
| 5,241,818 | * | 9/1993 | Shekleton et al. | 60/39.36 |

FOREIGN PATENT DOCUMENTS

| | | |
|---|---|---|
| 674852 | 5/1966 | (BE) . |
| 301137 | 11/1954 | (CH) . |
| 1476785 | 10/1969 | (DE) . |
| 0321809 | 6/1989 | (EP) . |
| 0353192 | 1/1990 | (EP) . |
| 0590297 | 4/1994 | (EP) . |
| 0704657 | 4/1996 | (EP) . |
| 514620 | 11/1939 | (GB) . |

* cited by examiner

*Primary Examiner*—Timothy S. Thorpe
*Assistant Examiner*—Ehud Gartenberg
(74) *Attorney, Agent, or Firm*—Oblon, Spivak, McClelland, Maier & Neustadt, P.C.

(57) ABSTRACT

A combustion chamber in a gas-turbine, wherein the combustion chamber has an annular-toroidal-shaped interior space. A plurality of burners are arranged on the periphery of the combustion chamber, wherein the burners are operatively connected to the annular-toroidal-shaped interior space so as to initiate a swirl flow. The swirl flow forms a vortex core and the vortex core ensures the stability of the flame front.

4 Claims, 2 Drawing Sheets

COMBUSTION CHAMBER OF A GAS TURBINE

BACKGROUND OF THE INVENTION

1. Field of the Invention

The present invention relates to a combustion chamber having an interior space to which burners are operatively connected.

2. Discussion of Background

Combustion chambers of modern gas-turbines are preferably designed as annular combustion chambers. They are arranged axially in the direction of flow between compressor and turbine, care being taken to ensure that the hot gases formed there are directed optimally in terms of flow and combustion between the two fluid-flow machines, normally between compressor and turbine. This regularly leads to such annular combustion chambers having a relatively long axial extent if, in particular, the combustion stipulations or minimum requirements are to be met. The combustion aspects have a not insignificant effect on the absolute axial length of such combustion chambers. The length of a main annular combustion chamber is regularly decisive for the design of the entire gas-turbine; thus, for example, whether more than two bearings then have to be provided for the rotor support, or whether the gas-turbine has to be of twin-shaft design. This initial situation is accentuated when the gas-turbine is operated with sequential firing; the axial lengths of the two combustion chambers of annular design are then decisive for the feasibility and largely also for the market acceptance of such a machine. For the abovementioned reasons, the gas-turbines with annular combustion chambers which have been disclosed by the prior art have, without exception, a considerable length, as a result of which the further step towards a qualitative leap concerning the compactness of these plants remains blocked.

In addition, it should be pointed out that elongated combustion chambers tend to initiate pulsations within the combustion-space section, these pulsations then having an adverse effect on the operation of the burners, in particular if these premix burners work with an integrated premix section and have a backflow zone as a flame retention baffle.

SUMMARY OF THE INVENTION

Accordingly, one object of the present invention, is to provide a combustion chamber of the type mentioned at the beginning, is to propose measures which are able to remove at least the disadvantages listed above.

An essential advantage of the present invention may be seen in the fact that the combustion chamber, while maintaining superior combustion with regard to the efficiency and the minimization of the pollutant emissions, has an extremely compact axial length such that this same combustion chamber, in combination with the fluid-flow machines of a gas-turbine, no longer has any important effect on the rotor length.

A further essential advantage of the present invention may be seen in the fact that this combustion chamber is of basically very simple construction. Its design in terms of combustion and flow permits optimum fluidic operation upon admission of the hot gases to the downstream turbine.

As viewed geometrically, this combustion chamber is essentially of toroidal configuration, certain deviations from an ideal torus form being permissible. Such a combustion chamber can be arranged without problem between any two fluid-flow machines. Furthermore, the combustion chamber according to the present invention is just the right combustion chamber for installing as a retrofit unit in existing gas turbines, for example in place of a silo combustion chamber.

In addition, this combustion chamber, in particular in the case of premix combustion, develops its full potential with regard to maximizing the efficiency and minimizing the pollutant emissions.

Owing to the fact that the combustion process inside this combustion chamber takes place entirely in a compact toroidal space, several fluidic advantages, which up to now could only be achieved by the implementation of costly and complicated measures, can be achieved at the same time. These advantages can be listed as follows, in which case the following explanations do not claim to be definitive:

The removal of pulsations, which, in particular in the case of premix combustion, adversely affect the flame front and the backflow zone, which is in interdependent relationship with the flame front.

The distribution and injection of the fuel or fuels is of very simple configuration. The burners, to the greatest possible extent, react insensitively to non-uniformity in the fuel injection, whether caused by pressure differences or by delays in the responsiveness during load variations.

Leakage during the introduction of the combustion air or non-uniform injection of the fuel has no effect on or only a slight effect on the so-called pattern factors at the turbine inlet. Therefore a robust hot-gas flow, which is unaltered by external factors or interference, is formed inside the annular toroidal interior space in the shape of a swirl flow.

A congenial swirled hot-gas flow for admission to the downstream turbine is fluidically formed inside this annular toroidal interior space by virtue of the fact that the hot gases flow directly to the turbine without further flow deflections. The forming centrifugal-force zone of this vortex then results in considerable evening out of the gas-temperature distribution in the peripheral direction in such a way that hot gases are then admitted to the blading of the turbine over the entire periphery and they have a uniform pressure profile and temperature profile. The torus form of the combustion chamber combined with the centrifugal-force zone reduces the convective heat transfer to a minimum on account of the gas centrifuge effect and the flow against a concave wall. In addition, the smallest possible surface is achieved for a predetermined combustion-chamber volume.

There is great interdependence between the individual burners distributed over the periphery of the annular toroidal interior space. At the same time, the operating characteristic, during a shut-down of individual burners, does not behave intermittently with regard to the hot gases delivered to the turbine. Accordingly, such a combustion chamber, without giving up the advantages of the hot-gas flow forming in the annular toroidal interior space, can be run up from part-load operation to full load without problem or, conversely, can be reduced in load in a controlled manner. The cross ignition is therefore decisively improved. Ignition over cold burners is possible. The burner graduation in the peripheral direction is therefore also possible in the case of a single-row burner arrangement. The simple operating concept also leads to low pollutant emissions (NOx, CO, UHC) at part load.

If the combustion chamber is operated with premix burners, for example according to one of the proposals according to EP-B1-0 321 809 (EV) or EP-A2-0 704 657 (AEV), which form an integral part of this description, the swirl flow from the individual burners, by appropriate disposition of the same in the peripheral direction of the annular toroidal interior space, can easily be transformed into a uniform vortex flow inside the interior space, in the course of which a stable core, which fulfills the function of a bodiless flame retention baffle, forms in the center of this interior space. There is therefore a causal relationship between the stability of this vortex core and the fact that it has uniform tightness in the region of its annular axis.

Such an annular toroidal combustion chamber is also suitable for being used in a sequentially fired gas-turbine group, preferably as a high-pressure combustion chamber, but not only as such. Thus, it may also be readily used as a self-igniting combustion chamber within sequential combustion by a system of vortex generators being provided in place of the premix burners proposed here, which vortex generators, in a manner analogous to a burner-operated combustion chamber, form a vortex core for stabilizing the flame front against flashback.

However, the premix burners proposed here are not an indispensable condition for the operation of the annular toroidal combustion chamber. Thanks to its design, this combustion chamber may also be readily operated with diffusion burners.

In addition, the geometrically simple configuration and compact form of this combustion chamber permits efficient cooling of its liner with a minimized quantity of the cooling medium used in each case. This is a very important aspect, in particular in those cases in which a quantity of air from the compressor is used to cool the combustion chamber.

Furthermore, this combustion chamber is also suitable for operation with both liquid and gaseous fuels, without losses of quality. In particular during operation with a liquid fuel, the pollutant emissions are minimized extremely well, as will be specified in more detail further below.

From the abovementioned fluidic relationships, the excellent flame stabilization minimizes the pollutant emissions, in particular as far as the NOx emissions are concerned. NOx emissions of less than 5 vppm (15% $O_2$) are achievable. But the other pollutant emissions, such as CO and UHC, can also be reduced with the combustion chamber according to the present invention, for the toroidal space, i.e. the vortex conduction of the hot gases, also acts as an intensive compact burn-out zone. The likewise low pollutant emissions at part load have already been dealt with in more detail above.

Advantageous and expedient developments of the achievement of the object according to the present invention are defined in the further dependent claims.

BRIEF DESCRIPTION OF THE DRAWINGS

A more complete appreciation of the present invention and many of the attendant advantages thereof will be readily obtained as the same becomes better understood by reference to the following detailed description when considered in connection with the accompanying drawings, wherein.

DESCRIPTION OF THE PREFERRED EMBODIMENTS

Figure 1:
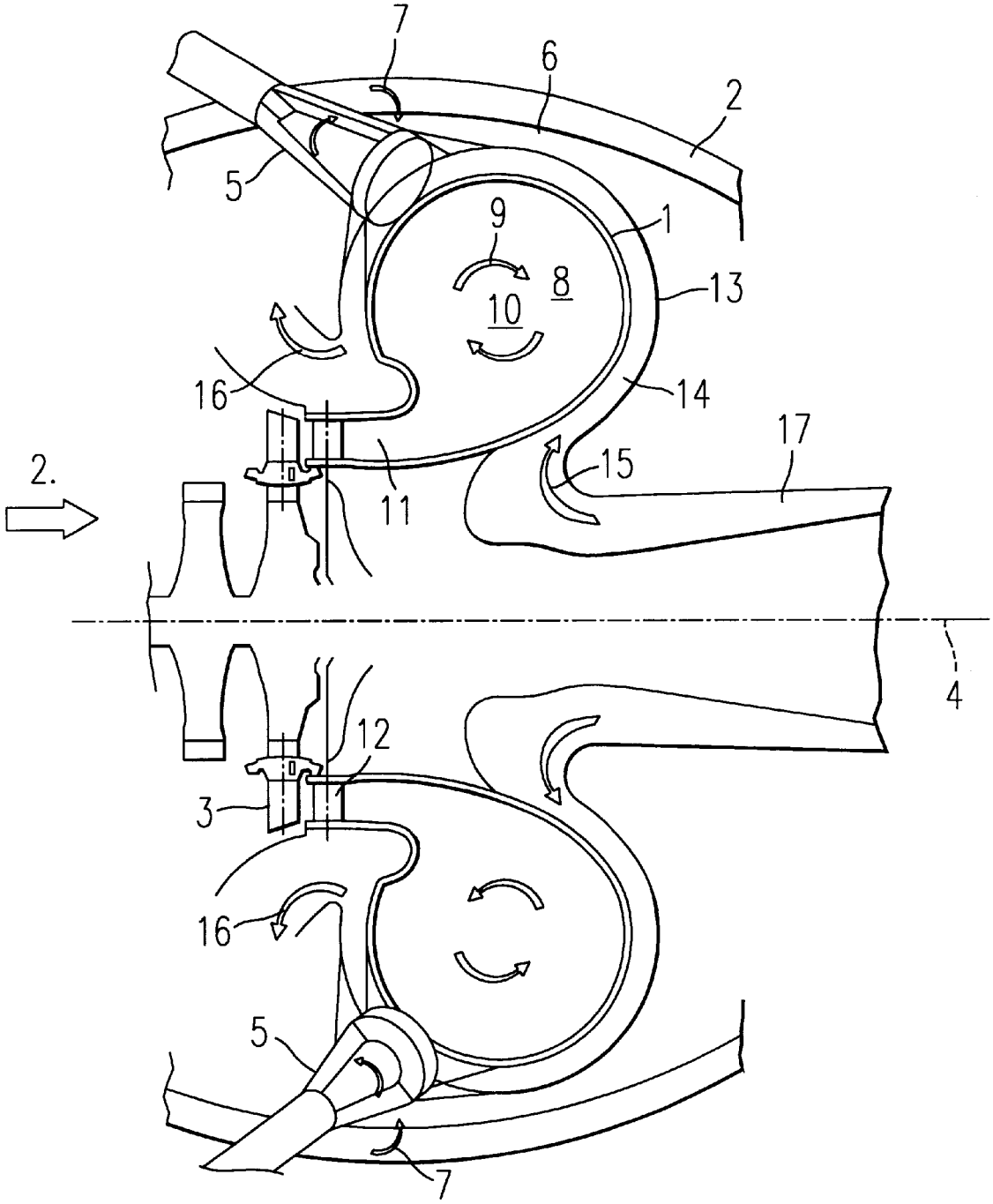
FIG. 1 shows an axial section of a toroidal combustion chamber subjected to flow.

Referring now to the drawings, wherein like reference numerals designate identical or corresponding parts throughout the several views, all the elements not required for directly understanding the present invention have been omitted, and the direction of flow of the media is identified by arrows, FIG. 1 shows a combustion chamber for operating a gas-turbine. This combustion chamber 1 has an annular toroidal form which extends around the axis rotor 4, which is only shown by way of intimation. This annular toroidal combustion chamber 1 is also of extremely compact radial configuration such that it can be accommodated without problem inside a casing 2 which is designed for an annular combustion chamber. Compared with an annular combustion chamber, this toroidal combustion chamber 1 has a minimized axial extent, so that the toroidal combustion chamber 1 has no effect on the rotor length of the gas-turbine, whereby such a rotor then turns out to be very short, which has a positive effect on, inter alia, the bearing arrangement. The combustion processes in the axial direction of flow within an annular combustion chamber belonging to the prior art take place to at least the same quality level within the toroidal interior space 8 in the case of the toroidal combustion chamber 1 described here, the admission of hot gases to the downstream turbine 3 then taking place in an optimum manner, for a hot-gas flow which has a uniform temperature and pressure profile forms in the toroidal interior space 8 itself. The operation of the toroidal combustion chamber 1 is maintained by a number of premix burners 5, which are distributed regularly or irregularly in the peripheral direction of the combustion chamber 1. The configuration of these premix burners 5 preferably complies with the proposals according to EP-B1-0 321 809 or EP-A2-0 704 657, all the statements made in these publications forming an integral part of the present description. These premix burners 5 are fed from a plenum 6 with combustion air 7 which originates from a compressor (not shown in any more detail). The combustion air 7 flows tangentially into the premix burners 5 and produces a swirl flow there, which propagates in the toroidal interior space 8 and, at this location, turns into a vortex flow of hot gases 9 having a stable core 10. This hot-gas flow 9 then flows continuously in a uniform mass and consistency and without flow deflections into a hot-gas duct 11, the end of which is preferably fitted with guide blades 12 in the peripheral direction. Once this hot-gas flow 9 is optimally oriented to the fluidic requirements of the downstream turbine 3 via guide blades 12, the admission of the hot gases to the moving blades belonging to the turbine is then effected according to a known technique. The fluidic formation of the vortex hot-gas flow 9 is affected by the disposition of the premix burners 5 in the peripheral direction, in which case, for the configuration of the combustion chamber 1 proposed here, all options are open with regard to the position of the premix burners 5 in the peripheral direction of the toroidal combustion chamber 1. In FIG. 1, the premix burners 5 are positioned tangentially relative to their plane of inflow into the toroidal interior space 8 and they run at an acute angle relative to the admission plane of the turbine 3. The fluidic quality of the vortex hot-gas flow 9 may accordingly be altered by the premix burners 5 being arranged, for example, at right angles relative to the admission plane of the turbine 3 on the periphery of the toroidal combustion chamber 1. A further arrangement may have an angle of greater than 90° relative to the admission plane. In all the arrangements, the hot gases 9 being produced by the premix burners 5 preferably continue to flow tangentially into the toroidal interior space 8, so that the stability of the annular core 10 of this hot-gas flow remains ensured. Here, the individual premix burners 5 are switched on or off smoothly, i.e. the individual premix burners 5 are operationally interdependent, so that, during start-up or shut-down, the individual premix burners, which do not need an ignition device, react with maximized responsiveness. Due to the compact combustion space of this combustion chamber 1, which is formed solely by the toroidal interior space 8, the generation of pulsations is counteracted, since the vortex hot-gas flow, because of its fluidic stability and impulse intensity, does not permit any feedback of combustion-chamber-specific frequences to the premix burners 5 or the flame front. Thus, the generation of pulsations is counteracted in a striking manner by the geometric configuration of this toroidal combustion chamber 1. In addition, the indisputably extremely compact type of construction of this toroidal combustion chamber 1 is especially suitable for achieving efficient cooling with a minimized quantity of cooling medium. In FIG. 1 it is shown how such cooling may take place. The toroidal combustion chamber 1 is enclosed by a shell 13. A cooling-air flow 15, which is branched off from the compressor unit via an annular duct 17, passes along through an intermediate space 14 which is formed by this shell 13 relative to the wall of the combustion chamber 1. After cooling of the outer wall of the toroidal combustion chamber 1 has taken place, the cooling-air flow quantity 16 basically passes into the plenum 6. However, this quantity of air 16 used for the cooling may be directed, for example, into the combustion chamber 1 or into the premix burners 5, in each case at a suitable point. As far as the swirl flows from the burners are concerned, care is to be taken to ensure that the number of swirl flows remains subcritical over all the operating stages of the combustion chamber. The result of this is that, in principle, the gas tightness of the vortex core turns out to be largely uniform during a base load of the machine, a factor which is reflected in the stability of the vortex core and in the dwell time of the hot gases in this region. A vortex core formed in this way surprisingly develops a direct stabilization of the flame front in accordance with a bodiless flame retention baffle relative to the individual burners arranged at the periphery, whereby efforts to stabilize the flame in the domain of these burners no longer take absolute precedence.

Figure 2:
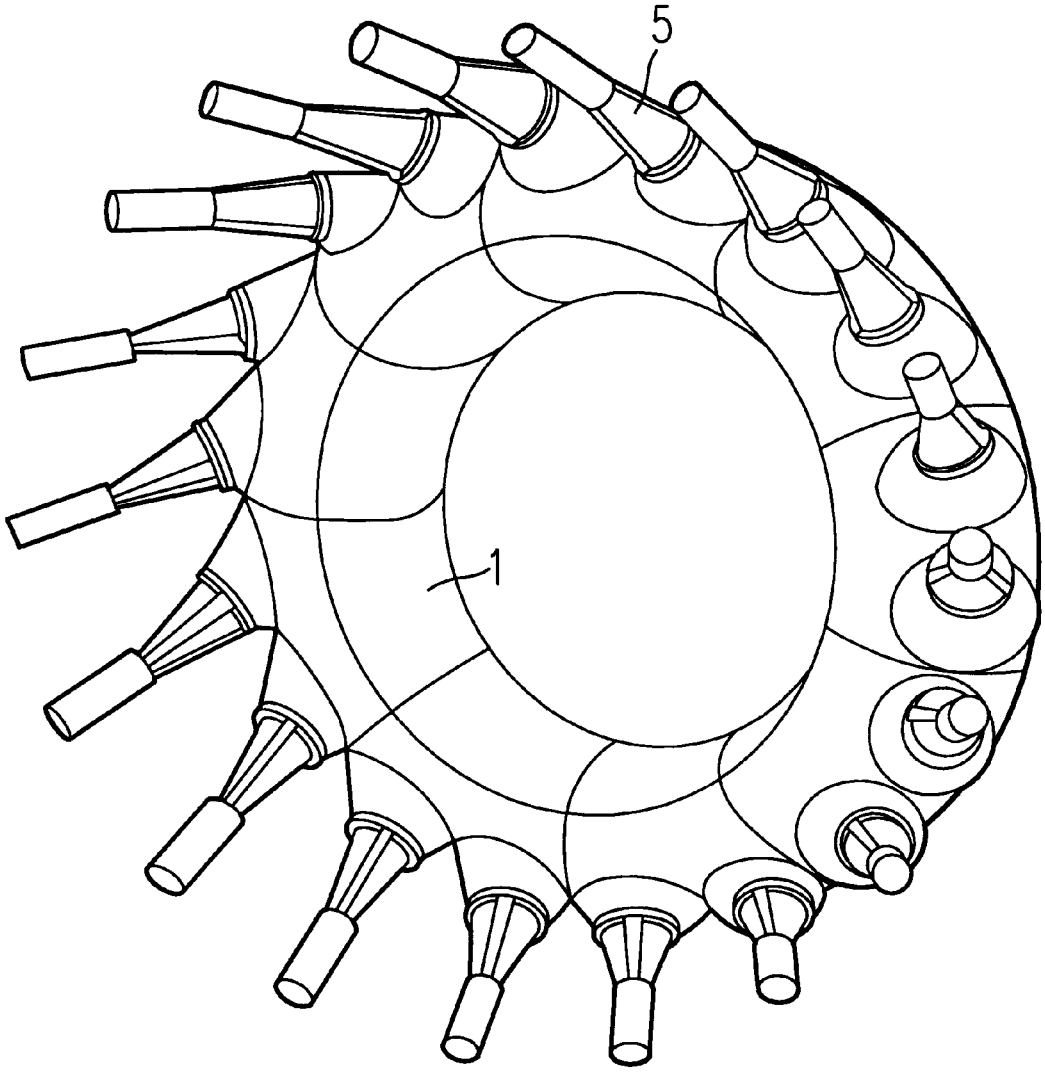
FIG. 2 shows a torus which forms the combustion chamber.

FIG. 2 shows the toroidal combustion chamber 1 from the outside looking in the direction of arrow II in FIG. 1, this representation being detached from the rest of the infrastructure of the gas turbine. This figure shows in a concise manner the geometric design of the combustion chamber as well as the distribution and position of the premix burners 5. The premix burners 5 are arranged tangentially on the periphery of the toroidal combustion chamber 1. The fluid-dynamic aspects of this configuration have already been dealt with in detail with reference to FIG. 1.

The toroidal combustion chamber 1 shown has particular advantages, the main points of which are to be summarized here again, from which the advantages specified further above are largely obtained.

1. The centrifugal-force zone of the vortex leads to the distribution of the gas temperatures being evened out to a considerable degree in the peripheral direction.
   The burner graduation in the peripheral direction is also possible in the case of a single-row burner arrangement, in contrast to combustion chambers without a swirl. A simple operating concept with low pollutant emissions (NOx, CO, UHC) is also ensured at part load.
2. The torus form of the combustion chamber combined with the centrifugal-force zone of the vortex reduces the convective heat transfer to a minimum (gas centrifuge effect, flow against concave wall) . In addition, the smallest possible surface is obtained for a predetermined combustion-chamber volume.
3. The cross ignition within the burner combination is decisively improved. Ignition over cold burners is possible.
4. The combustion chamber has a compact overall length.

Obviously, numerous modifications and variations of the present invention are possible in light of the above teachings. It is therefore to be understood that, within the scope of the appended claims, the present invention may be practiced otherwise than as specifically described herein.

LIST OF DESIGNATIONS

Combustion chamber
Casing
Turbine
Rotor
Burner, premix burner
Plenum
Combustion air
Interior space
Hot gases, hot-gas flow, vortex hot-gas flow, swirl flow
Core of item 9, vortex core
Hot-gas duct
Guide blades
Shell
Intermediate space
Cooling medium, cooling-air flow
Cooling-air flow quantity
Annular duct

What is claimed as new and desired to be secured by Letters Patent of the United States is:

1. A combustion chamber of a gas-turbine, said combustion chamber comprising:

at least one annular toroidal interior space of quasi-circular cross-section;

a plurality of burners, wherein each burner of said plurality of burners is in operative connection with said at least one annular toroidal interior space so as to be tangentially arranged on a periphery of said combustion chamber and wherein each burner of said plurality of burners is a pre-mix burner;

a hot-gas outlet duct defining an incident-flow plane of a downstream turbine of said gas-tuxbine, said hot-gas duct connected to said annular toroidal interior space, wherein said hot-gas duct is branched off in a peripheral tangential direction of said annular toroidal interior space; and wherein in cross-sectional of said annular toroidal interior space, the axis vector pointing out of any of said burners and the axis vector pointing into said hot-gas outlet duct, point in the same direction.

2. The combustion chamber as claimed in claim 1, wherein said hot-gas duct has guide blades at first end thereof, said guide blades being in operative connection with moving blades of said downstream turbine.

3. The combustion chamber as claimed in claim 1, wherein said at least one annular toroidal interior space is encased by a shell, and wherein a cooling medium flows in an intermediate space formed between said shell and an external shape of said at least one annular toroidal interior space.

4. The combustion chamber as claimed in claim 1, wherein said burners are in operative connection with a plenum, and wherein combustion air from said plenum feeds said burners.

* * * * *

UNITED STATES PATENT AND TRADEMARK OFFICE

CERTIFICATE OF CORRECTION

PATENT NO. : 6,192,669 B1
DATED : February 27, 2001
INVENTOR(S) : Keller et al.

It is certified that error appears in the above-identified patent and that said Letters Patent is hereby corrected as shown below:

On the title page, the CPA information has been omitted. It should read as follows:

--- (45) **Date of Patent: *Feb. 27, 2001** ---

--- ( * ) Notice: This patent issued on a continued prosecution application filed under 37 CFR 1.53(d), and is subject to the twenty year patent term provisions of 35 U.S.C. 154(a)(2). ---

Signed and Sealed this

Seventh Day of August, 2001

*Attest:*

Nicholas P. Godici

*Attesting Officer*

NICHOLAS P. GODICI
*Acting Director of the United States Patent and Trademark Office*